US012654213B2

(12) United States Patent
Ono et al.

(10) Patent No.: US 12,654,213 B2
(45) Date of Patent: Jun. 16, 2026

(54) IRREGULARLY-SHAPED DIE

(71) Applicant: A.L.M.T. Corp., Tokyo (JP)

(72) Inventors: Akihito Ono, Hyogo (JP); Kohichiroh Kimura, Hyogo (JP); Yuichiro Seki, Hyogo (JP)

(73) Assignee: A.L.M.T. Corp., Tokyo (JP)

( * ) Notice: Subject to any disclaimer, the term of this patent is extended or adjusted under 35 U.S.C. 154(b) by 253 days.

(21) Appl. No.: 18/707,849

(22) PCT Filed: Nov. 15, 2022

(86) PCT No.: PCT/JP2022/042424

§ 371 (c)(1),
(2) Date: May 6, 2024

(87) PCT Pub. No.: WO2023/090324

PCT Pub. Date: May 25, 2023

(65) Prior Publication Data

US 2025/0001478 A1 Jan. 2, 2025

(30) Foreign Application Priority Data

Nov. 17, 2021 (JP) ..... 2021-187105

(51) Int. Cl.
*B21C 3/02* (2006.01)
*B21C 3/04* (2006.01)

(52) U.S. Cl.
CPC ..... *B21C 3/02* (2013.01); *B21C 3/025* (2013.01); *B21C 3/04* (2013.01)

(58) Field of Classification Search
CPC .. B21C 1/00; B21C 3/02; B21C 3/025; B21C 3/04; B21C 3/06
See application file for complete search history.

(56) References Cited

U.S. PATENT DOCUMENTS 4,016,736 A * 4/1977 Carrison ..... B21C 3/025 72/41
2019/0060968 A1 2/2019 Sumiya et al.
2019/0329308 A1* 10/2019 Shindo ..... B21C 3/025

FOREIGN PATENT DOCUMENTS

JP 2005254311 A 9/2005
JP 2012195212 A 10/2012
(Continued)

OTHER PUBLICATIONS

Translation of WO-2017073424-A1.*
(Continued)

*Primary Examiner* — Bobby Yeonjin Kim
(74) *Attorney, Agent, or Firm* — Renner, Otto, Boisselle & Sklar, LLP

(57) ABSTRACT

There is provided an irregularly-shaped diamond die for producing an irregularly-shaped wire, wherein a processing hole is provided, the processing hole having a reduction portion and a bearing portion in this order from an upstream side in a wire drawing direction, a corner portion having a curved shape and a non-corner portion located at a position different from a position of the corner portion are provided in a cross section of the bearing portion perpendicular to the wire drawing direction, and a surface roughness of the corner portion is greater than a surface roughness of the non-corner portion. The surface roughness Sa of the corner portion is equal to or less than 0.30 μm and the surface roughness Sa of the non-corner portion is equal to or less than 0.20 μm.

7 Claims, 3 Drawing Sheets

(56) References Cited

FOREIGN PATENT DOCUMENTS

| | | | | |
|---|---|---|---|---|
| JP | 2017-154153 | A | 9/2017 | |
| WO | WO-2017073424 | A1 * | 5/2017 | ..... B21C 3/025 |
| WO | 2018/123513 | A1 | 7/2018 | |

OTHER PUBLICATIONS

Decision to Grant a Patent in corresponding Japanese Application No. 2023-562347, mailed Feb. 4, 2025, with English translation.
Notification in corresponding Japanese Application No. 2023-562347, mailed Dec. 10, 2024, with English translation.

* cited by examiner

IRREGULARLY-SHAPED DIE

TECHNICAL FIELD

The present disclosure relates to an irregularly-shaped die. The present application claims the priority based on Japanese Patent Application No. 2021-187105 filed on Nov. 17, 2021. The entire contents of the description in this Japanese patent application are incorporated herein by reference.

BACKGROUND ART

Conventionally, an irregularly-shaped die is disclosed in, for example, International Publication No. 2018/123513 (PTL 1).

CITATION LIST

Patent Literature

PTL 1: International Publication No. 2018/123513

SUMMARY OF INVENTION

An irregularly-shaped die according to the present disclosure is an irregularly-shaped die for producing an irregularly-shaped wire, wherein a processing hole is provided, the processing hole having a reduction portion and a bearing portion in this order from an upstream side in a wire drawing direction, a corner portion having a curved shape and a non-corner portion located at a position different from a position of the corner portion are provided in a cross section of the bearing portion perpendicular to the wire drawing direction, and a surface roughness of the corner portion is greater than a surface roughness of the non-corner portion. The surface roughness Sa of the corner portion is equal to or less than 0.30 μm and the surface roughness Sa of the non-corner portion is equal to or less than 0.20 μm.

DESCRIPTION OF EMBODIMENTS

Problem to be Solved by the Present Disclosure

The accuracy of an irregularly-shaped wire produced using a conventional irregularly-shaped die is low.

Effect of the Present Disclosure

According to the present disclosure, the processing accuracy of an irregularly-shaped wire can be improved.

Details of Embodiment (Overall Configuration)

Figure 1:
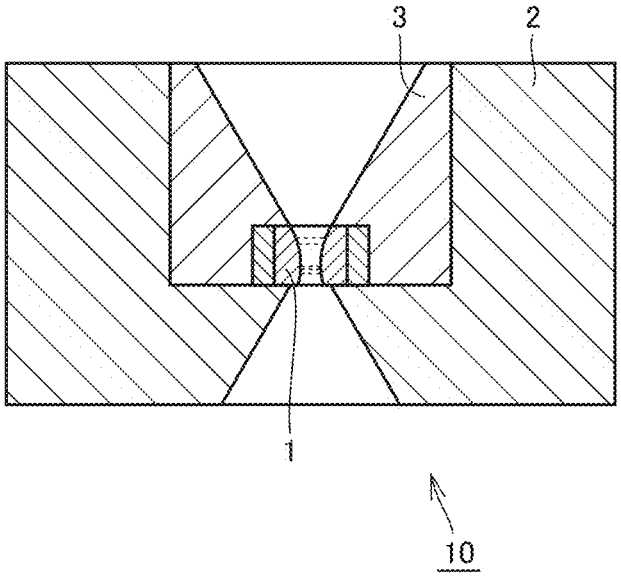
FIG. 1 is a cross-sectional view of an irregularly-shaped diamond die 10 according to an embodiment, diamond 1 that constitutes irregularly-shaped diamond die 10, a case 2 that houses diamond 1, and a sintered alloy 3 interposed therebetween.

An overview of a diamond die for wire drawing of an irregularly-shaped wire will be described with reference to the drawings. FIG. 1 is a cross-sectional view of an irregularly-shaped diamond die 10 according to an embodiment, diamond 1 that constitutes irregularly-shaped diamond die 10, a case 2 that houses diamond 1, and a sintered alloy 3 interposed therebetween. FIG. 1 is a cross-sectional view showing a state in which irregularly-shaped diamond die 10 can be used, with diamond 1 housed in the die case. Diamond 1 is housed in case 2. Diamond 1 is attached to case 2 using sintered alloy 3. In irregularly-shaped diamond die 10 serving as an irregularly-shaped die, a portion that processes a wire is made of, for example, diamond 1.

Figure 2:
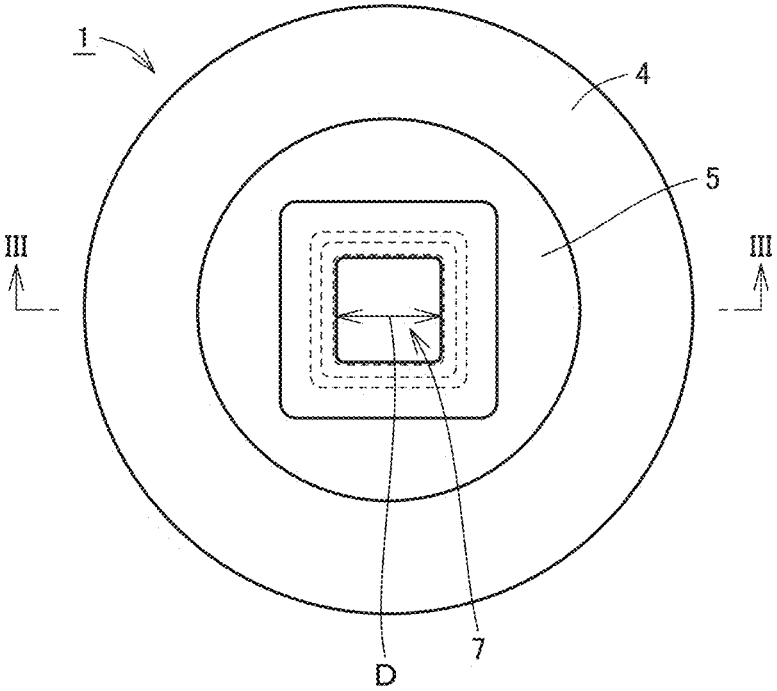
FIG. 2 is a front view of diamond 1 shown in FIG. 1.
Figure 3:
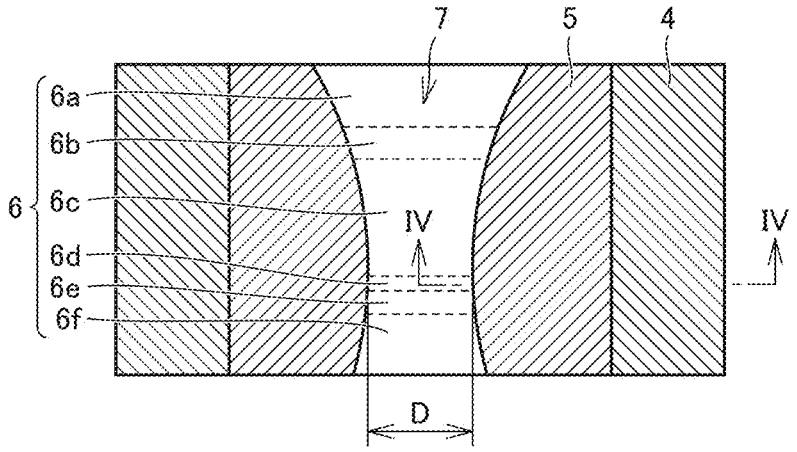
FIG. 3 is a cross-sectional view taken along line III-III in FIG. 2.
Figure 4:
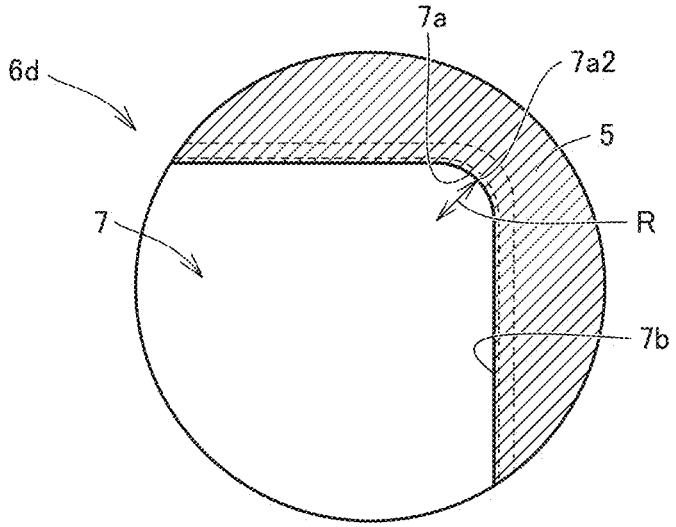
FIG. 4 is an enlarged cross-sectional view of a bearing portion 6*d* taken along line IV-IV in FIG. 3.

FIG. 2 is a front view of diamond 1 shown in FIG. 1. FIG. 3 is a cross-sectional view taken along line III-III in FIG. 2. FIG. 4 is an enlarged cross-sectional view of a bearing portion 6*d* taken along line IV-IV in FIG. 3. As shown in FIGS. 2 to 4, diamond 1 has polycrystalline diamond 5 surrounded by a support ring 4 made of cemented carbide. A central portion includes a hole inner surface 6 and a processing hole 7, and a wire to be subjected to wire drawing passes through processing hole 7 while coming into contact with hole inner surface 6. Hole inner surface 6 is further divided and details thereof are shown in FIG. 3. Hole inner surface 6 is divided into a bell portion 6*a*, an approach portion 6*b*, a reduction portion 6*c*, a bearing portion 6*d*, a back relief portion 6*e*, and an exit portion of in this order, and processing hole 7 has a shape similar to a quadrangular shape when viewed from the front, as shown in FIG. 2. Bearing portion 6*d* is a region of processing hole 7 including a portion having a smallest diameter.

At least a surface extending from bell portion 6*a* to bearing portion 6*d*, of hole inner surface 6 formed by processing hole 7, is formed by a smooth curved surface in a thickness direction of diamond. In other words, unlike a configuration in which each of bell portion 6*a*, approach portion 6*b*, reduction portion 6*c*, and bearing portion 6*d* is formed linearly and boundary portions thereof are rounded, the portions as a whole are formed by a smooth curved surface. This curved surface is formed by a curved surface of single R or a curved surface of composite R, and boundary portions thereof have a shape that is not clearly known.

A wire diameter of a wire subjected to a wire drawing process using irregularly-shaped diamond die 10 is approximately 10 mm, which is thick. In the case of subjecting such a thick wire to the wire drawing process, when the surface extending from bell portion 6*a* to bearing portion 6*d* is formed by a smooth curved surface, a wire drawing resistance does not change greatly, a scratch is less likely to occur on a surface of the wire subjected to the wire drawing process, and small surface roughness and undulation are achieved. In addition, from the perspective of supplying a lubricant, excellent lubrication conditions are achieved when the surface extending from bell portion 6*a* to bearing portion 6*d* is formed by a smooth curved line.

Polycrystalline diamond 5 around processing hole 7 is single polycrystalline diamond that is continuous in a circumferential direction of processing hole 7. Since polycrystalline diamond 5 around processing hole 7 is single polycrystalline diamond that is continuous in the circumferential direction of the processing hole, polycrystalline diamond 5 has a higher strength than a strength of divided diamond. As a result, the accuracy of the processing hole can be higher and the surface roughness of the wire subjected to wire drawing can be smaller.

(Lengths of Reduction Portion 6*c* and Bearing Portion 6*d*)

When bearing portion 6*d* has a quadrangular front shape and D represents a distance between the facing surfaces of the quadrangular shape, a region having a length of 1.0 D in the wire drawing direction corresponds to bearing portion 6*d*. A portion having a smallest inner diameter corresponds to the center of bearing portion 6*d*, and a region extending upward by 0.5 D and downward by 0.5 D in the wire drawing direction from the portion corresponds to bearing portion 6*d*. A region located upstream of bearing portion 6*d* so as to be adjacent to bearing portion 6*d* and having a length of 0.5 D in the wire drawing direction corresponds to reduction portion 6*c*. Generally, longer length of bearing portion 6*d* is more preferable from the perspective of improving the life of irregularly-shaped diamond die 10, i.e., preventing wear and shape change of polycrystalline diamond 5.

However, when an ultrafine wire is subjected to wire drawing, wire breakage is a big problem, and thus, bearing portion 6*d* cannot be made long. In order to prevent wire breakage, it is necessary to take measures from the following two perspectives, i.e., decreasing a contact area between polycrystalline diamond 5 and the wire, and decreasing the friction force per unit area. Therefore, first of all, from the perspective of decreasing the contact area with the wire, it is preferable to make bearing portion 6*d* short. As a result, the friction force is reduced.

In addition, since the smooth curved surface makes it possible to decrease the contact area, to prevent the lubricant from running out, and to stabilize the wire drawing resistance, the wire breakage prevention effect is remarkable. Furthermore, in the case of subjecting bearing portion 6*d* to polishing, it is difficult to achieve a smooth surface having a small surface roughness when the length of bearing portion 6*d* is long. However, since the length of bearing portion 6*d* is short, polishing can be performed with high accuracy, which also provides the effect of stabilizing the wire drawing resistance.

(Surface Roughness Sa of Bearing Portion 6*d*)

When surface roughness Sa of a corner portion 7*a* and surface roughness Sa of a non-corner portion 7*b* having a straight line shape in bearing portion 6*d* are compared, the surface roughness of corner portion 7*a* is greater. The surface roughness Sa of the corner portion is equal to or less than 0.30 μm, and the surface roughness Sa of the non-corner portion is equal to or less than 0.20 μm. Preferably, the surface roughness Sa of corner portion 7*a* is equal to or less than 0.15 μm, and the surface roughness Sa of non-corner portion 7*b* is equal to or less than 0.10 μm. More preferably, the surface roughness Sa of corner portion 7*a* is equal to or less than 0.10 μm, and the surface roughness Sa of non-corner portion 7*b* is equal to or less than 0.07 μm.

The surface roughness Sa is defined by ISO 25178. A range in which there are 20 or more peaks and valleys therein is set as a measurement range. Measurement is conducted under the conditions of with measurement pretreatment, with inclination correction, and without a Gaussian filter. Bearing portion 6*d* is a portion of processing hole 7 having a smallest diameter and the surface roughness of bearing portion 6*d* is deeply related to the surface roughness of the wire. The surface roughness Sa of the non-corner portion of bearing portion 6*d* is preferably equal to or less than 0.05 μm. In order to achieve a high-accuracy and long-life die, the surface roughness Sa of bearing portion 6*d* is more preferably equal to or less than 0.03 μm, and most preferably equal to or less than 0.01 μm. Smaller surface roughness Sa of bearing portion 6*d* is more preferable. However, in consideration of the cost effectiveness on industrial production, the surface roughness Sa of bearing portion 6*d* is preferably equal to or more than 0.002 μm.

In order to measure the surface roughness Sa of bearing portion 6*d*, a transfer material (e.g., RepliSet manufactured by Marumoto Struers K.K.) is filled into processing hole 7 of the irregularly-shaped die and a replica onto which the surface of processing hole 7 has been transferred is produced. This replica is observed using a laser microscope (e.g., VK-X series shape analysis laser microscope manufactured by Keyence Corp.) and the surface roughness Sa is measured at arbitrary three locations in corner portion 7*a* and non-corner portion 7*b*. Average values of the surface roughnesses Sa measured at these three locations in corner portion 7*a* and non-corner portion 7*b* are defined as the surface roughnesses Sa of corner portion 7*a* and non-corner portion 7*b* of bearing portion 6*d*, respectively. As to the surface roughness Sa of the wire subjected to wire drawing as well, the surface is observed using the laser microscope and the surface roughness Sa is measured at arbitrary three locations. An average value of the surface roughnesses Sa at these three locations is defined as the surface roughness Sa of the wire.

(Surface Roughness of Reduction Portion 6*c*)

Figure 5:
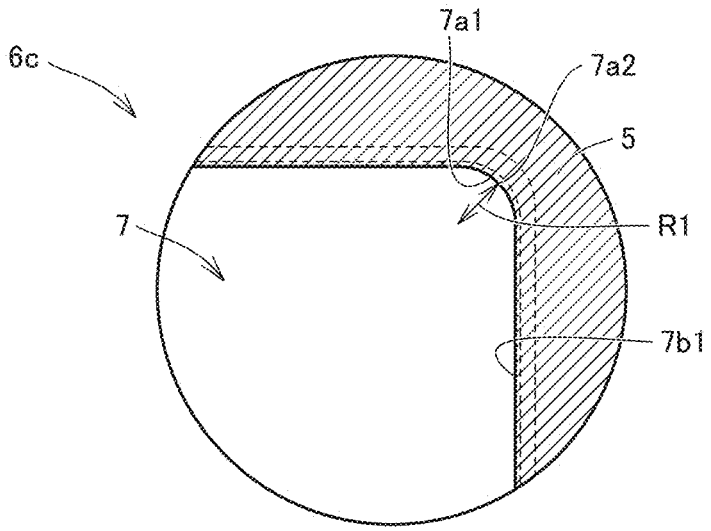
FIG. 5 is a cross-sectional view corresponding to FIG. 4 and shows a corner portion 7*a*1 and a non-corner portion 7*b*1 in a reduction portion 6*c*.

FIG. 5 is a cross-sectional view corresponding to FIG. 4 and shows a corner portion 7*a*1 and a non-corner portion 7*b*1 in reduction portion 6*c*. Preferably, the surface roughness Sa of corner portion 7*a*1 of reduction portion 6*c* is equal to or less than 0.10 μm, the surface roughness Sa of non-corner portion 7*b*1 of reduction portion 6*c* is equal to or less than 0.07 μm, and a difference between the surface roughness Sa of non-corner portion 7*b* of bearing portion 6*d* and the surface roughness Sa of non-corner portion 7*b*1 of reduction portion 6*c* is equal to or less than 0.05 μm.

In this case, the surface roughness of reduction portion 6*c* located upstream of bearing portion 6*d* is small, and thus, the surface roughness of the wire subjected to wire drawing can be made small.

In order to achieve a high-accuracy and long-life die, the surface roughness Sa of each of corner portion 7*a*1 and non-corner portion 7*b*1 of reduction portion 6*c* is more preferably equal to or less than 0.05 μm, and most preferably equal to or less than 0.03 μm. Smaller surface roughness Sa of reduction portion 6*c* is more preferable. However, in consideration of the cost effectiveness on industrial production, the surface roughness Sa of reduction portion 6*c* is preferably equal to or more than 0.01 μm.

The surface roughness of reduction portion 6*c* is measured using the same method as the method for measuring the surface roughness of bearing portion 6*d*.

(Lengths of Sides and R of Corner Portion)

The wire subjected to wire drawing is used as a winding of a motor, and the like. In such an application, winding the wire at high density is required, and thus, smaller R of the corner portion of the wire is more preferable. Therefore, the R of corner portion 7*a* of the quadrangular shape in the bearing portion is equal to or less than 20 μm. Smaller R of corner portion 7*a* is more preferable. However, in consideration of the cost effectiveness on industrial production, the R of corner portion 7*a* is preferably equal to or more than 1 μm.

Although the case in which processing hole 7 has a quadrangular shape is described in the present embodiment, the shape of processing hole 7 is not limited to the quadrangular shape and may be another polygonal shape such as a triangular shape or a hexagonal shape. It is preferable that many cross sections orthogonal to a longitudinal direction of the wire include a straight line portion. Furthermore, when the sides have different lengths, the length of the longest side is preferably equal to or less than 1000 μm. There is no lower limit to the length of the longest side. However, when the longest side is too short, the manufacturing cost is high on industrial production. Therefore, in consideration of the cost effectiveness, the length of the longest side is preferably equal to or more than 5 μm.

Although processing hole 7 has a quadrangular shape in the present embodiment, the shape of processing hole 7 is not limited thereto and may be a track shape formed by connecting a straight line and a semicircle.

(Opening Angle at Reduction Portion 6*c*)

Figure 6:
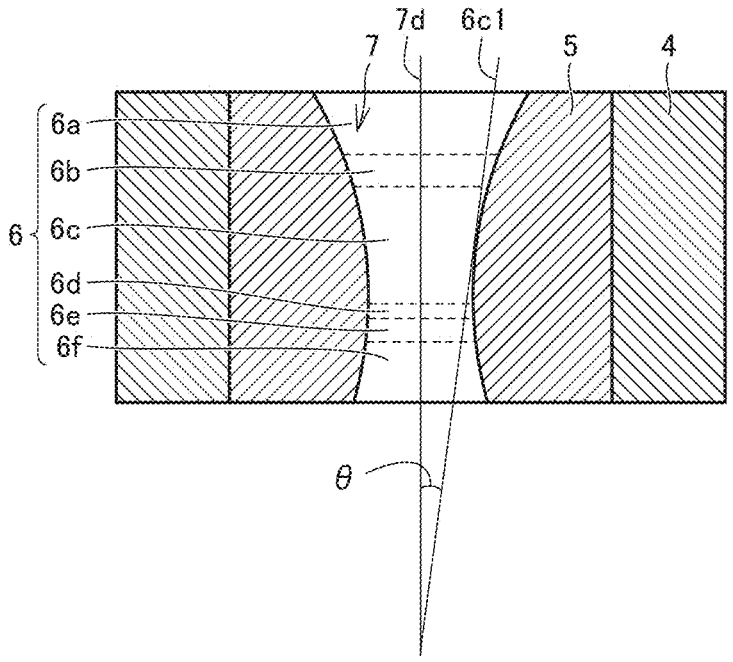
FIG. 6 is a cross-sectional view of a processing hole 7 in a wire drawing direction, for illustrating an opening angle.

FIG. 6 is a cross-sectional view of processing hole 7 in the wire drawing direction, for illustrating an opening angle. In the present disclosure, a cross-sectional shape of reduction portion 6*c* (reduction cross section) and a cross-sectional shape of bearing portion 6*d* are substantially similar figures. An angle θ formed by a tangent line 6*cl* of a wall surface and a center line 7*d* in reduction portion 6*c* corresponds to an opening angle at reduction portion 6*c* (hereinafter, referred to as "reduction angle"). Tangent line 6*cl* and reduction portion 6*c* are in contact with each other at a center position in the wire drawing direction in reduction portion 6*c*.

A reduction angle of corner portion 7*a*1 may be different from a reduction angle of non-corner portion 7*b*1.

The reduction angle of corner portion 7*a*1 may be greater than the reduction angle of non-corner portion 7*b*1.

By making the reduction angle of corner portion 7*a*1 greater than the reduction angle of non-corner portion 7*b*1 as described above, an area reduction ratio of corner portion 7*a*1 can be set to be greater than an area reduction ratio of non-corner portion 7*b*1. As a result, the wire subjected to the wire drawing process is narrowed more sharply in corner portion 7*a*1 than in non-corner portion 7*b*1. By doing so, even a large-diameter wire targeted by the irregularly-shaped die according to the present disclosure is easily processed up to every part of corner portion 7*a*1. Thus, the shape accuracy of the wire subjected to the wire drawing process is improved. In addition, although increasing the area reduction ratio leads to an increase in resistance during wire drawing, the increase in resistance during wire drawing is suppressed and the problem of breakage of the wire becomes less likely to occur, by setting the surface roughness as described above.

Furthermore, the reduction angle of corner portion 7*a*1 becomes greater with increasing distance from non-corner portion 7*b*1. Specifically, the reduction angle may become greater toward a tip 7*a*2 of corner portion 7*a*1. Tip 7*a*2 of corner portion 7*a*1 refers to a portion of corner portion 7*a*1 having a greatest distance from center line 7*d*.

By setting the shape as described above, tip 7*a*2 of corner portion 7*a*1 has a largest area reduction ratio and the wire is easily processed up to tip 7*a*2 of corner portion 7*a*1. In addition, in a process for manufacturing the irregularly-shaped die, processing of corner portion 7*a*1 becomes easier and the accuracy of corner portion 7*a*1 can be easily improved.

(Diamond Particle Size)

In order to make the R of corner portion 7*a*1 smaller, and further to make the surface roughness Sa of bearing portion 6*d* smaller, diamond that constitutes polycrystalline diamond 5 must have a small particle size. Polycrystalline diamond (sintered diamond) 5 having an average particle size of equal to or less than 500 nm is preferably used.

In order to achieve a high-accuracy and long-life die, the average particle size of diamond is more preferably equal to or less than 300 nm, and most preferably equal to or less than 100 nm. Smaller average particle size of diamond is more preferable. However, the cost of ultrafine diamond particles is high on industrial production, and thus, the average particle size of diamond is preferably equal to or more than 5 nm.

In order to measure the average particle size of the diamond particles, a photograph of polycrystalline diamond 5 is taken at arbitrary three locations within a range of 5 μm×5 μm using a scanning electron microscope. Individual diamond particles are extracted from the taken image and the extracted diamond particles are subjected to a binarization process, thereby calculating an area of each diamond particle. A diameter of a circle having the same area as the area of each diamond particle is defined as the particle size of the diamond particle. An arithmetic average value of the diamond particle sizes (diameters of the circles) is defined as the average particle size.

(Binder)

Polycrystalline diamond 5 may include a binder. A ratio of the binder in the polycrystalline diamond is preferably equal to or less than 5 volume %. In order to achieve a high-accuracy and long-life die, the ratio of the binder is more preferably equal to or less than 3 volume %, and it is most preferable that polycrystalline diamond 5 should include no binder.

In order to measure the ratio of the binder, a photograph of polycrystalline diamond 5 is taken at arbitrary three locations within a range of 5 μm×5 μm using the scanning electron microscope as described in the paragraph of "(Diamond Particle Size)" above. The taken image is read using the Adobe Photoshop or the like, a threshold value that matches the original image is calculated through contour tracing, and black and white conversion is performed using the threshold value. An area of the binder displayed in white as a result of the black and white conversion can be calculated. The diamond particles are displayed in gray and a grain boundary is displayed in black. The area ratio of the binder is defined as the volume ratio of the binder.

(Material)

In the example above, the wire is processed using diamond 1. However, in the irregularly-shaped die, bearing portion 6*d* may be made of a hard material other than diamond 1.

Examples of the material of bearing portion 6*d* include cubic boron nitride (CBN) or cemented carbide. The material of bearing portion 6*d* can be determined depending on a material of a wire to be processed.

(Method for Manufacturing Irregularly-Shaped Diamond Die 10)

As a material of irregularly-shaped diamond die 10, sintered diamond having an average particle size of equal to or less than 5 μm is prepared. The sintered diamond is processed into a cylindrical shape, and then, a hole is bored therein by a laser processing method. Next, coarse processing is performed by an electrical discharge processing method. Next, polishing of the hole is performed. Ultrasonic polishing is performed using a diamond powder and a polishing needle, and finishing is performed.

(First Polishing) Ultrasonic polishing is performed using a diamond powder having a particle size of 0 to 2 μm.

(Second Polishing) Ultrasonic polishing is performed using a diamond powder having a particle size of 0 to 1 μm.

(Third Polishing) Ultrasonic polishing is performed using a diamond powder having a particle size of 0 to ¼ μm.

(Fourth Polishing) Wire polishing is performed using a diamond powder having a particle size of 0 to 1/10 μm.

Non-corner portion 7*b* is polished in a more focused manner than corner portion 7*a*. As a result, the surface roughness Sa of non-corner portion 7*b* of bearing portion 6*d* becomes 0.026 μm and the surface roughness Sa of corner portion 7*a* of bearing portion 6*d* becomes 0.042 μm. The surface roughness Sa of non-corner portion 7*b*1 of reduction portion 6*c* becomes 0.029 μm and the surface roughness Sa of corner portion 7*a*1 of reduction portion 6*c* becomes 0.058 μm.

It is common practice to polish diamond while gradually making a powder for processing finer. Although diamond is adequately polished by spending a lot of time, there is no standard about how adequately diamond should be polished. In the present disclosure, the corner portion and the non-corner portion are polished within a defined value of high accuracy that is considered to be necessary for the wire drawing process, as compared with a conventional polishing method. Therefore, the stress in the wire can be made uniform and wire habits such as a twist can be improved.

A reason why the surface roughness of non-corner portion 7*b* is made smaller than the surface roughness of corner portion 7*a* is that non-corner portion 7*b* is processed greatly and corner portion 7*a* is not so greatly processed as compared with non-corner portion 7*b* in irregularly-shaped diamond die 10. By making smaller the surface roughness Sa of non-corner portion 7*b* where the wire is greatly processed, the occurrence of the problem such as a twist is suppressed.

In order to make the surface roughness of corner portion 7*a* small, corner portion 7*a* needs to be polished with high accuracy. However, since corner portion 7*a* is curved with a small radius R, polishing of corner portion 7*a* with high accuracy can possibly cause deformation of corner portion 7*a*, and in this case, the shape of the wire cannot be kept. Furthermore, since corner portion 7*a* does not so greatly contribute to processing as compared with non-corner portion 7*b*, making the surface roughness of corner portion 7*a* greater than the surface roughness of non-corner portion 7*b* does not cause the problem such as a twist of the wire.

An irregularly-shaped die according to the present disclosure is an irregularly-shaped die for producing an irregularly-shaped wire, wherein processing hole 7 is provided, processing hole 7 having reduction portion 6*c* and bearing portion 6*d* in this order from an upstream side in a wire drawing direction, corner portion 7*a* having a curved shape and non-corner portion 7*b* located at a position different from a position of corner portion 7*a* are provided in a cross section of bearing portion 6*d* perpendicular to the wire drawing direction, and a surface roughness of corner portion 7*a* is greater than a surface roughness of non-corner portion 7*b*.

Preferably, the surface roughness Sa of corner portion 7*a* is equal to or less than 0.10 μm, and the surface roughness Sa of non-corner portion 7*b* is equal to or less than 0.07 μm.

Preferably, corner portion 7*a*1 having a curved shape and non-corner portion 7*b*1 located at a position different from a position of corner portion 7*a*1 are provided in a cross section of reduction portion 6*c* perpendicular to the wire drawing direction, the surface roughness Sa of corner portion 7*a*1 of reduction portion 6*c* is equal to or less than 0.10 μm, the surface roughness Sa of non-corner portion 7*b*1 of reduction portion 6*c* is equal to or less than 0.07 μm, and a difference between the surface roughness Sa of non-corner portion 7*b*1 of reduction portion 6*c* and the surface roughness Sa of non-corner portion 7*b* of bearing portion 6*d* is equal to or less than 0.05 μm.

The wire to be subjected to wire drawing can be various types of metals such as copper, silver, iron, gold, and aluminum.

Examples

Sample Nos. 1 to 8

TABLE 1

| | Die specifications | | | | | | | Die performance |
|---|---|---|---|---|---|---|---|---|
| | Bearing portion | | | Surface roughness of bearing portion (μmSa) | | Surface roughness of reduction portion (μmSa) | | Surface roughness of wire subjected to wire drawing process |
| Sample No. | Length of each of facing sides (μm) | Length of each of other facing sides (μm) | R of corner portion (μm) | Corner portion 7a | Non-corner portion 7b | Corner portion 7a1 | Non-corner portion 7b1 | |
| 1 | 100 | 100 | 20 | 0.09 | 0.06 | 0.15 | 0.10 | A |
| 2 | 100 | 100 | 20 | 0.10 | 0.07 | 0.15 | 0.10 | A |
| 3 | 100 | 100 | 20 | 0.13 | 0.08 | 0.15 | 0.10 | B |
| 4 | 100 | 100 | 20 | 0.15 | 0.10 | 0.15 | 0.10 | B |
| 5 | 100 | 100 | 20 | 0.20 | 0.15 | 0.15 | 0.10 | C |
| 6 | 100 | 100 | 20 | 0.30 | 0.20 | 0.20 | 0.15 | D |
| 7 | 100 | 100 | 20 | 0.35 | 0.25 | 0.20 | 0.15 | E |
| 8 | 100 | 100 | 20 | 0.042 | 0.026 | 0.058 | 0.029 | A |

Irregularly-shaped diamond dies of Sample Nos. 1 to 8 shown in Table 1 in which various numerical values were variously set were prepared to have the shape shown in FIGS. 1 to 5.

The irregularly-shaped diamond die of Sample No. 1 was made by the following method. First, a pilot hole was bored in polycrystalline diamond having various average particle sizes by the laser processing method, and then, coarse processing was performed by the electrical discharge processing method. Next, finishing processing was performed by lapping processing. In the lapping processing method, a stainless wire having a rectangular cross-sectional shape of 95 μm×50 μm, with each corner portion thereof having roundness of R 20 μm, was first produced by a rolling processing method. A side of 95 μm of the stainless wire was brought into contact with one side of the die hole and moved in a reciprocating manner for finishing processing, while supplying a diamond slurry (including diamond having a particle size of 0.2 μm). The remaining three sides were also subjected to finishing processing by the same method.

A quadrangular wire having each side of 105 μm and made of copper was subjected to the wire drawing process (wire drawing speed: 10 m/min) in a lubricant and a test was performed for one hour, to obtain a quadrangular wire having a length of 600 m. The surface roughness Sa of the wire in a direction orthogonal to the wire drawing direction of the quadrangular wire subjected to one-hour wire drawing was evaluated in accordance with ISO 25178. The surface roughness was evaluated at a portion of the length of 600 m. The results are shown in Table 1.

When the surface roughness Sa of the quadrangular wire subjected to wire drawing in Sample No. 1 was represented as 1, a sample having the surface roughness Sa of 0.8 to 1 in relative value was determined as evaluation A, a sample having the surface roughness Sa of more than 1 and equal to or less than 1.1 in relative value was determined as evaluation B, a sample having the surface roughness Sa of more than 1.1 and equal to or less than 1.3 in relative value was determined as evaluation C, a sample having the surface roughness Sa of more than 1.3 and equal to or less than 1.4 in relative value was determined as evaluation D, and a sample having the surface roughness Sa of more than 1.4 in relative value was determined as evaluation E. The samples determined as evaluation A to evaluation D can be put to practical use.

According to Table 1, in all of the samples, the surface roughness of corner portion 7*a* is greater than the surface roughness of non-corner portion 7*b*.

Preferably, the surface roughness Sa of corner portion 7*a* is equal to or less than 0.15 μm and the surface roughness Sa of non-corner portion 7*b* is equal to or less than 0.10 μm.

More preferably, the surface roughness Sa of corner portion 7*a* is equal to or less than 0.10 μm and the surface roughness Sa of non-corner portion 7*b* is equal to or less than 0.07 μm.

More preferably, the surface roughness Sa of the corner portion of reduction portion 6*c* is equal to or less than 0.15 μm, the surface roughness Sa of the non-corner portion of the reduction portion is equal to or less than 0.10 μm, and a difference between the surface roughness Sa of the reduction portion and the surface roughness Sa of the bearing portion is equal to or less than 0.05 μm.

Sample Nos. 11 to 13

TABLE 2

| | Die specifications | | | | | | | Die performance |
|---|---|---|---|---|---|---|---|---|
| | Bearing portion | | | Surface roughness of bearing portion (μmSa) | | Surface roughness of reduction portion (μmSa) | | Surface roughness of wire subjected to wire drawing process |
| Sample No. | Length of each of facing sides (μm) | Length of each of other facing sides (μm) | R of corner portion (μm) | Corner portion 7a | Non-corner portion 7b | Corner portion 7a1 | Non-corner portion 7b1 | |
| 11 | 100 | 100 | 20 | 0.10 | 0.07 | 0.12 | 0.08 | A |
| 12 | 100 | 100 | 20 | 0.10 | 0.07 | 0.15 | 0.10 | A |
| 13 | 100 | 100 | 20 | 0.10 | 0.07 | 0.17 | 0.12 | B |

Irregularly-shaped diamond dies of Sample Nos. 11 to 13 shown in Table 2 in which various numerical values were variously set were prepared to have the shape shown in FIGS. 1 to 5.

The wire drawing conditions were stricter than the wire drawing conditions of Sample Nos. 1 to 8.

A quadrangular wire having each side of 105 μm and made of copper was subjected to the wire drawing process (wire drawing speed: 13 m/min) in a lubricant and a test was performed for one hour, to obtain a quadrangular wire having a length of 780 m. The surface roughness Sa of the wire in a direction orthogonal to the wire drawing direction of the quadrangular wire subjected to one-hour wire drawing was evaluated in accordance with ISO 25178. The surface roughness was evaluated at a portion of the length of 780 m. The results are shown in Table 2.

When the surface roughness Sa of the quadrangular wire subjected to wire drawing in Sample No. 11 was represented as 1, a sample having the surface roughness Sa of 0.8 to 1 in relative value was determined as evaluation A, and a sample having the surface roughness Sa of more than 1 and equal to or less than 1.1 in relative value was determined as evaluation B.

Sample Nos. 21 to 28

TABLE 3

| Sample No. | Die specifications: Bearing portion: Length of each of facing sides (μm) | Bearing portion: Length of each of other facing sides (μm) | Bearing portion: R of corner portion (μm) | Surface roughness of bearing portion (μmSa): Corner portion 7a | Surface roughness of bearing portion (μmSa): Non-corner portion 7b | Surface roughness of reduction portion (μmSa): Corner portion 7a1 | Surface roughness of reduction portion (μmSa): Non-corner portion 7b1 | Die performance Surface roughness of wire subjected to wire drawing process |
|---|---|---|---|---|---|---|---|---|
| 21 | 2000 | 4000 | 300 | 0.049 | 0.028 | 0.055 | 0.030 | A |
| 22 | 2000 | 4000 | 300 | 0.055 | 0.032 | 0.065 | 0.035 | A |
| 23 | 2000 | 4000 | 300 | 0.052 | 0.029 | 0.068 | 0.035 | A |
| 24 | 2000 | 4000 | 300 | 0.053 | 0.030 | 0.105 | 0.055 | B |
| 25 | 2000 | 4000 | 300 | 0.052 | 0.030 | 0.101 | 0.054 | B |
| 26 | 2000 | 4000 | 300 | 0.055 | 0.050 | 0.110 | 0.060 | C |
| 27 | 2000 | 4000 | 300 | 0.049 | 0.061 | 0.120 | 0.075 | D |
| 28 | 2000 | 4000 | 300 | 0.115 | 0.055 | 0.112 | 0.061 | E |

Irregularly-shaped diamond dies of Sample Nos. 21 to 28 shown in Table 3 in which various numerical values were variously set were prepared to have the shape shown in FIGS. 1 to 5.

A quadrangular wire having one side of 2100 μm and another side of 4200 μm and made of copper was subjected to the wire drawing process (wire drawing speed: 13 m/min) in a lubricant and a test was performed for one hour, to obtain a quadrangular wire having a length of 780 m. The surface roughness Sa of the wire in a direction orthogonal to the wire drawing direction of the quadrangular wire subjected to one-hour wire drawing was evaluated in accordance with ISO 25178. The surface roughness was evaluated at a portion of the length of 780 m. The results are shown in Table 3.

When the surface roughness Sa of the quadrangular wire subjected to wire drawing in Sample No. 21 was represented as 1, a sample having the surface roughness Sa of 0.8 to 1 in relative value was determined as evaluation A, a sample having the surface roughness Sa of more than 1 and equal to or less than 1.1 in relative value was determined as evaluation B, a sample having the surface roughness Sa of more than 1.1 and equal to or less than 1.3 in relative value was determined as evaluation C, a sample having the surface roughness Sa of more than 1.3 and equal to or less than 1.4 in relative value was determined as evaluation D, and a sample having the surface roughness Sa of more than 1.4 in relative value was determined as evaluation E. The samples determined as evaluation A to evaluation D can be put to practical use.

Sample Nos. 31 to 38

TABLE 4

| Sample No. | Die specifications: Bearing portion: Length of each of facing sides (μm) | Bearing portion: Length of each of other facing sides (μm) | Bearing portion: R of corner portion (μm) | Surface roughness of bearing portion (μmSa): Corner portion 7a | Surface roughness of bearing portion (μmSa): Non-corner portion 7b | Surface roughness of reduction portion (μmSa): Corner portion 7a1 | Surface roughness of reduction portion (μmSa): Non-corner portion 7b1 | Die performance Surface roughness of wire subjected to wire drawing process |
|---|---|---|---|---|---|---|---|---|
| 31 | 5000 | 7000 | 500 | 0.064 | 0.030 | 0.069 | 0.042 | A |
| 32 | 5000 | 7000 | 500 | 0.060 | 0.035 | 0.065 | 0.045 | A |
| 33 | 5000 | 7000 | 500 | 0.065 | 0.033 | 0.070 | 0.040 | A |
| 34 | 5000 | 7000 | 500 | 0.061 | 0.055 | 0.067 | 0.040 | B |
| 35 | 5000 | 7000 | 500 | 0.065 | 0.058 | 0.071 | 0.041 | B |
| 36 | 5000 | 7000 | 500 | 0.059 | 0.060 | 0.100 | 0.039 | C |
| 37 | 5000 | 7000 | 500 | 0.060 | 0.063 | 0.105 | 0.055 | D |
| 38 | 5000 | 7000 | 500 | 0.101 | 0.059 | 0.110 | 0.060 | E |

Irregularly-shaped diamond dies of Sample Nos. 31 to 38 shown in Table 4 in which various numerical values were variously set were prepared to have the shape shown in FIGS. 1 to 5.

A quadrangular wire having one side of 5250 μm and another side of 7350 μm and made of copper was subjected to the wire drawing process (wire drawing speed: 13 m/min) in a lubricant and a test was performed for one hour, to obtain a quadrangular wire having a length of 780 m. The surface roughness Sa of the wire in a direction orthogonal to the wire drawing direction of the quadrangular wire subjected to one-hour wire drawing was evaluated in accordance with ISO 25178. The surface roughness was evaluated at a portion of the length of 780 m. The results are shown in Table 4.

When the surface roughness Sa of the quadrangular wire subjected to wire drawing in Sample No. 31 was represented as 1, a sample having the surface roughness Sa of 0.8 to 1 in relative value was determined as evaluation A, a sample having the surface roughness Sa of more than 1 and equal to or less than 1.1 in relative value was determined as evaluation B, a sample having the surface roughness Sa of more than 1.1 and equal to or less than 1.3 in relative value was determined as evaluation C, a sample having the surface roughness Sa of more than 1.3 and equal to or less than 1.4 in relative value was determined as evaluation D, and a sample having the surface roughness Sa of more than 1.4 in relative value was determined as evaluation E. The samples determined as evaluation A to evaluation D can be put to practical use.

Sample Nos. 41 to 48

TABLE 5

| | Die specifications | | | | | | | Die performance Surface |
|---|---|---|---|---|---|---|---|---|
| | Bearing portion | | | Surface roughness of bearing portion (μmSa) | | Surface roughness of reduction portion (μmSa) | | roughness of wire subjected |
| Sample No. | Length of each of facing sides (μm) | Length of each of other facing sides (μm) | R of corner portion (μm) | Corner portion 7a | Non-corner portion 7b | Corner portion 7a1 | Non-corner portion 7b1 | to wire drawing process |
| 41 | 7000 | 9000 | 600 | 0.063 | 0.036 | 0.071 | 0.039 | A |
| 42 | 7000 | 9000 | 600 | 0.071 | 0.041 | 0.084 | 0.045 | A |
| 43 | 7000 | 9000 | 600 | 0.067 | 0.037 | 0.087 | 0.045 | A |
| 44 | 7000 | 9000 | 600 | 0.068 | 0.039 | 0.135 | 0.071 | B |
| 45 | 7000 | 9000 | 600 | 0.067 | 0.039 | 0.130 | 0.069 | B |
| 46 | 7000 | 9000 | 600 | 0.071 | 0.064 | 0.141 | 0.077 | C |
| 47 | 7000 | 9000 | 600 | 0.063 | 0.078 | 0.154 | 0.096 | D |
| 48 | 7000 | 9000 | 600 | 0.148 | 0.071 | 0.144 | 0.078 | E |

Irregularly-shaped diamond dies of Sample Nos. 41 to 48 shown in Table 5 in which various numerical values were variously set were prepared to have the shape shown in FIGS. 1 to 5.

A quadrangular wire having one side of 7350 μm and another side of 9450 μm and made of copper was subjected to the wire drawing process (wire drawing speed: 13 m/min) in a lubricant and a test was performed for one hour, to obtain a quadrangular wire having a length of 780 m. The surface roughness Sa of the wire in a direction orthogonal to the wire drawing direction of the quadrangular wire subjected to one-hour wire drawing was evaluated in accordance with ISO 25178. The surface roughness was evaluated at a portion of the length of 780 m. The results are shown in Table 5.

When the surface roughness Sa of the quadrangular wire subjected to wire drawing in Sample No. 41 was represented as 1, a sample having the surface roughness Sa of 0.8 to 1 in relative value was determined as evaluation A, a sample having the surface roughness Sa of more than 1 and equal to or less than 1.1 in relative value was determined as evaluation B, a sample having the surface roughness Sa of more than 1.1 and equal to or less than 1.3 in relative value was determined as evaluation C, a sample having the surface roughness Sa of more than 1.3 and equal to or less than 1.4 in relative value was determined as evaluation D, and a sample having the surface roughness Sa of more than 1.4 in relative value was determined as evaluation E. The samples determined as evaluation A to evaluation D can be put to practical use.

Sample Nos. 51 to 58

TABLE 6

| | Die specifications | | | | | | | Die performance Surface |
|---|---|---|---|---|---|---|---|---|
| | Bearing portion | | | Surface roughness of bearing portion (μmSa) | | Surface roughness of reduction portion (μmSa) | | roughness of wire subjected |
| Sample No. | Length of each of facing sides (μm) | Length of each of other facing sides (μm) | R of corner portion (μm) | Corner portion 7a | Non-corner portion 7b | Corner portion 7a1 | Non-corner portion 7b1 | to wire drawing process |
| 51 | 9000 | 11000 | 700 | 0.101 | 0.047 | 0.108 | 0.066 | A |
| 52 | 9000 | 11000 | 700 | 0.094 | 0.055 | 0.102 | 0.071 | A |
| 53 | 9000 | 11000 | 700 | 0.102 | 0.052 | 0.110 | 0.063 | A |

TABLE 6-continued

| | Die specifications | | | | | | | Die performance |
|---|---|---|---|---|---|---|---|---|
| | Bearing portion | | | Surface roughness of bearing portion (μmSa) | | Surface roughness of reduction portion (μmSa) | | Surface roughness of wire subjected to wire drawing process |
| Sample No. | Length of each of facing sides (μm) | Length of each of other facing sides (μm) | R of corner portion (μm) | Corner portion 7a | Non-corner portion 7b | Corner portion 7a1 | Non-corner portion 7b1 | |
| 54 | 9000 | 11000 | 700 | 0.096 | 0.086 | 0.105 | 0.063 | B |
| 55 | 9000 | 11000 | 700 | 0.102 | 0.091 | 0.112 | 0.064 | B |
| 56 | 9000 | 11000 | 700 | 0.093 | 0.094 | 0.157 | 0.061 | C |
| 57 | 9000 | 11000 | 700 | 0.094 | 0.099 | 0.165 | 0.086 | D |
| 58 | 9000 | 11000 | 700 | 0.159 | 0.093 | 0.173 | 0.094 | E |

Irregularly-shaped diamond dies of Sample Nos. 51 to 58 shown in Table 6 in which various numerical values were variously set were prepared to have the shape shown in FIGS. 1 to 5.

A quadrangular wire having one side of 9450 μm and another side of 11550 μm and made of copper was subjected to the wire drawing process (wire drawing speed: 13 m/min) in a lubricant and a test was performed for one hour, to obtain a quadrangular wire having a length of 780 m. The surface roughness Sa of the wire in a direction orthogonal to the wire drawing direction of the quadrangular wire subjected to one-hour wire drawing was evaluated in accordance with ISO 25178. The surface roughness was evaluated at a portion of the length of 780 m. The results are shown in Table 6.

When the surface roughness Sa of the quadrangular wire subjected to wire drawing in Sample No. 51 was represented as 1, a sample having the surface roughness Sa of 0.8 to 1 in relative value was determined as evaluation A, a sample having the surface roughness Sa of more than 1 and equal to or less than 1.1 in relative value was determined as evaluation B, a sample having the surface roughness Sa of more than 1.1 and equal to or less than 1.3 in relative value was determined as evaluation C, a sample having the surface roughness Sa of more than 1.3 and equal to or less than 1.4 in relative value was determined as evaluation D, and a sample having the surface roughness Sa of more than 1.4 in relative value was determined as evaluation E. The samples determined as evaluation A to evaluation D can be put to practical use.

More preferably, the surface roughness Sa of corner portion 7*a*1 of reduction portion 6*c* is equal to or less than 0.15 μm, the surface roughness Sa of non-corner portion 7*b*1 of reduction portion 6*c* is equal to or less than 0.10 μm, and a difference between the surface roughness Sa of non-corner portion 7*b*1 of reduction portion 6*c* and the surface roughness Sa of non-corner portion 7*b* of bearing portion 6*d* is equal to or less than 0.05 μm.

It should be understood that the embodiment disclosed herein is illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1 diamond; 2 case; 3 sintered alloy; 4 support ring made of an alloy; 5 polycrystalline diamond; 6 hole inner surface; 6*a* bell portion; 6*b* approach portion; 6*c* reduction portion; 6*d* bearing portion; 6*e* back relief portion; 6*f* exit portion; 7 processing hole; 7*a*, 7*a*1 corner portion; 7*b*, 7*b*1 non-corner portion; 10 irregularly-shaped diamond die.

The invention claimed is:

1. An irregularly-shaped die for producing an irregularly-shaped wire, the irregularly-shaped die comprising:

a processing hole, wherein the processing hole has a reduction portion and a bearing portion in this order from an upstream side in a wire drawing direction, a corner portion having a curved shape and a non-corner portion located at a position different from a position of the corner portion that are provided in a cross section of the bearing portion perpendicular to the wire drawing direction, and a surface roughness Sa of the corner portion that is greater than a surface roughness Sa of the non-corner portion, wherein the surface roughness Sa of the corner portion is equal to or less than 0.30 μm and the surface roughness Sa of the non-corner portion is equal to or less than 0.20 μm.

2. The irregularly-shaped die according to claim 1, wherein the surface roughness Sa of the corner portion is equal to or less than 0.15 μm, and the surface roughness Sa of the non-corner portion is equal to or less than 0.10 μm.

3. The irregularly-shaped die according to claim 2, wherein the surface roughness Sa of the corner portion is equal to or less than 0.10 μm, and the surface roughness Sa of the non-corner portion is equal to or less than 0.07 μm.

4. The irregularly-shaped die according to claim 1, the irregularly-shaped die further comprising:

a corner portion having a curved shape and a non-corner portion located at a position different from a position of the corner portion that are provided in a cross section of the reduction portion perpendicular to the wire drawing direction, a surface roughness Sa of the corner portion of the reduction portion is equal to or less than 0.15 μm, a surface roughness Sa of the non-corner portion of the reduction portion is equal to or less than 0.10 μm, and wherein a difference between the surface roughness Sa of the non-corner portion of the reduction portion and the surface roughness Sa of the non-corner portion of the bearing portion is equal to or less than 0.05 μm.

5. The irregularly-shaped die according to claim 1, wherein an opening angle of reduction of the corner portion is different from an opening angle of reduction of the non-corner portion.

6. The irregularly-shaped die according to claim 5, wherein the opening angle of reduction of the corner portion is greater than the opening angle of reduction of the non-corner portion.

7. The irregularly-shaped die according to claim 6, wherein the opening angle of reduction of the corner portion becomes greater with increasing distance from the non-corner portion.

* * * * *